US006855179B2

(12) United States Patent
Roldan

(10) Patent No.: US 6,855,179 B2
(45) Date of Patent: Feb. 15, 2005

(54) TRANSPARENT, ELASTIC AND FREE-STANDING COMPOSITION, SUCH AS FOR THE MANUFACTURE OF CANDLES, AND THE FREE-STANDING CANDLE OBTAINED WITH THE COMPOSITION

(75) Inventor: Alberto Gonzalo Perez Roldan, Buenos Aires (AR)

(73) Assignee: Gabriel Sergio Gutbezahl, Buenos Aires (AR)

( * ) Notice: Subject to any disclaimer, the term of this patent is extended or adjusted under 35 U.S.C. 154(b) by 0 days.

(21) Appl. No.: 09/925,431

(22) Filed: Aug. 10, 2001

(65) Prior Publication Data

US 2002/0053159 A1 May 9, 2002

(30) Foreign Application Priority Data

Sep. 15, 2000 (AR) ..... P000104870
Jun. 21, 2001 (AR) ..... P010102961

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS 3,645,705 A 2/1972 Miller et al.
3,819,342 A 6/1974 Gunderman et al.
3,844,706 A * 10/1974 Tsaras ..... 431/288
5,132,355 A 7/1992 Nahlovsky
5,578,089 A 11/1996 Elsamaloty
5,783,657 A 7/1998 Pavlin et al.
5,879,694 A 3/1999 Morrison et al.
5,882,363 A 3/1999 Spaulding et al.
5,964,905 A * 10/1999 Camp et al. ..... 44/275
6,054,517 A 4/2000 Spaulding et al.
6,066,329 A 5/2000 Morrison et al.
6,096,102 A 8/2000 Matthäi et al.
6,111,055 A 8/2000 Berger et al.
6,471,731 B1 * 10/2002 Elliott et al. ..... 44/275
6,478,830 B2 * 11/2002 Allison et al. ..... 44/275

FOREIGN PATENT DOCUMENTS

EP 1188815 A2 * 3/2002
WO WO 01/12764 A1 2/2001

OTHER PUBLICATIONS

Petro–Canada, Process Oils, "Luminol T–White Mineral Oil" pp. 110.*
Petro–Canada White Oils "Typical Properties Purity Grade"., pp. 1.*
http;//www.oup–usa.org/pdh/PDH–100.PDF. C.M.Roland, "Kraton G1600 SEBS", pp. 161–163.*
http://www.lubricantsplus.co.nz/pdf/IM7873e.pdf Petro–Canada Lubricants TechData "PURITY", FG WO White Mineral Oils, pp. 1–2.*

(List continued on next page.)

*Primary Examiner*—Cephia D. Toomer
(74) *Attorney, Agent, or Firm*—Robert E. Bushnell, Esq.

(57) ABSTRACT

A composition includes a mixture of a hydrocarbon oil in a relation of about 75 to 88 in weight percent and at least one copolymer selected from the group of triblock and diblock polymers in a proportion from about 12 to 25 in weight percent, the hydrocarbon oil having a viscosity of at least 180 SUS@ at 37° C. (100° F.) and, when the viscosity is in CST@, the viscosity being greater than 32 CST@ at 40° C. (104° F.), and the flash point being greater than 220° C. (425° F.). Also a free standing candle is made with the composition, the candle maintaining a free standing condition even when lit by means of a flame produced as a consequence of the combustion of a wick that crosses the body of the candle projecting toward outside one of its ends.

3 Claims, 2 Drawing Sheets

OTHER PUBLICATIONS http://www. boucheranddjones.com/industrial.htm Industrial Lubricants AGMA Nos. & ISO–Viscosity System for Industrial Fluid Lubricants, pp. 1–3.*

Website:http://www.boucherandjones.com/industrial.htm, Industrial Lubricants, "Iso–viscosity System for Industrial Fluid Lubricants", "AGMA Numbers", pp. 1–3.*

Website:hhttp://www.lubricantsplus.conz/pdfIM7873e.pdf, Petro–Canada Tech Data "Purity FG WO White Mineral Oils", pp. 2.*

"Specification for SEMTOL® 500 White Mineral Oil, Technical Grade," Witco Refined Products, Crompton Corporation.

"*Penreco Mineral Oil NF Properties"* (1 page), print out from an Internet website—http://www.penreco.com/products/whtmnoils/NFproperties.asp, date unknown.

"*Penreco Material Safety Data Sheet—Drakeoil Mineral Oil—USP Graves"* (6 pages), print out from an Internet website—http://www.penreco.com/products/pdfs/whitemineraloil/mineraloilNF51PEN13391.pdf, date unknown.

"*The Gemstone Candle Collection—The next generation of candles!"* (*2 pages*), *printout from an Internet website* http://www.gemstonecandles.com, date unavailable.

"*The Gemstone Candle Collection—Product List"* (*2 pages*), *printout from an Internet website* http://www.gemstonecandles.com/page2.html, date unavailable.

"*Renoil Aromatic Oils"* (*1 page*), "*Renoil Paraffinic Oils"* (*2 pages*) *and "Paralux Paraffinic Oils from Chevron"* (*1 page*) *printout from an Internet website* http://www.renkertoil.com/aoils.html, http://www.renkertoil.com/poils.html, and http://www.renkertoil.com/pluxoils.html, respectively (Mar. 7, 2001 and Aug. 8, 2001).

* cited by examiner

TRANSPARENT, ELASTIC AND FREE-STANDING COMPOSITION, SUCH AS FOR THE MANUFACTURE OF CANDLES, AND THE FREE-STANDING CANDLE OBTAINED WITH THE COMPOSITION

CLAIM OF PRIORITY

This application makes reference to, incorporates the same herein, and claims all benefits accruing under 35 U.S.C. § 119 from an application entitled A TRANSPARENT, ELASTIC AND SELF-SUPPORTING COMPOUND FOR THE MANUFACTURE OF CANDLES AND THE CANDLE OBTAINED WITH SAID COMPOUND earlier filed in the Argentina National Institute of Industrial Property on Sep. 15, 2000, and there duly assigned Application Number P 000104870 by that Office and another application entitled A TRANSPARENT ELASTIC AND FREE-STANDING COMPOUND FOR THE MANUFACTURE OF CANDLES, AND THE FREE-STANDING CANDLE OBTAINED WITH THE COMPOUND earlier filed in the Argentina National Institute of Industrial Property on Jun. 21, 2001, and there duly assigned Application Number P 010102961 by that Office.

BACKGROUND OF THE INVENTION

1. Field of the Invention

A main object of this invention is to provide a transparent, elastic and free-standing composition, such as for the manufacture of candles, and the candle obtained with this composition. The component of the present invention is suitable as a raw material in the manufacture of candles in general, thereby providing new possibilities for the structure of candles, which are difficult to achieve or obtain with the materials that are currently used in the main structure of candles, although possible uses for the composition of the present invention should not be construed in a limiting sense. "Transparent" is understood to mean the condition of allowing the passing of the light through the composition, such as through the body of a candle. "Elastic" is understood to mean the characteristic of allowing contraction and elongation deformations of the composition, when pressing the surface of the composition and then the composition, such as a candle made with the composition, returning to an original shape when the pressure is released.

Further, "free standing" is understood to mean the composition, such as a candle made with the composition, having the ability to stand by itself at room temperature, such that even during use of a candle made with the composition, such that the heat of the candlewick's combustion does not melt nor deform the body of the candle made with the composition of the present invention.

2. Description of the Related Art

Traditional candles are known, such as those to be ignited and give light, which are formed having longer bodies, generally cylindrical, and with a lengthened candlewick included therein in relation to the candle's longitudinal axis. Such traditional candles are manufactured with materials such as paraffin, wax, tallow or stearin. However, such conventional candles have the inconvenience that, though being self supporting, they are not transparent nor elastic, so their decorative and ornamental abilities are limited.

Also, there is a well-known "oil candle" that is liquid, and therefore, requires a container for its manufacture and for usage of the candle. However, such "oil candle" is typically disadvantageous as to decorative abilities and with respect to the outside structure of the candle since, invariably, such "oil candles" depend on a recipient that contains the fuel. Further, compositions for such "oil candles" have to be commercialized separately, since such candle has to be conformed by the user.

Different realizations disclosing composition compositions that can be applied to the formation of candles are known and include a mixture of hydrocarbon oil in a range between 90% and 70% proportion and one or more copolymers selected from a group of triblock and diblock polymers in a range between 2% and 30% proportion. This is due to the fact that, with such proportions, it is possible to form solid and transparent gels that can be molded by thermal treatment. However, it is not disclosed that such above-described transparent gels can conform to the body of a free-standing candle which does not deform nor flash when burned during its use.

In this regard, U.S. Pat. No. 5,879,694 to Morrison et al. teaches a solid transparent gel candle including a hydrocarbon oil, a wick, and one or more triblock or multiblock copolymers, which constitute a thermoplastic elastic, and optionally uses a diblock copolymer. The preferred composition disclosed by Morrison et al. '694 contains from about 4% to about 20% polymer and about 80% to about 96% of hydrocarbon oil, preferably white oil. The selected polymer is a triblock polymer as "Kraton® G type", more particularly "Kraton® G-1650". In this regard, Morrison et al. '694 discloses that preferably, clear glass jars are used for a jar candle.

Also, U.S. Pat. No. 6,066,329 to Morrison et al. discloses a transparent stiff gel candle including a hydrocarbon oil, a wick and one or more triblock or multiblock copolymers of a thermoplastic rubber, and optionally, a diblock copolymer. A preferred composition disclosed in Morrison et al. '329 contains from about 4 to about 20 percent of the polymer and from about 80 to about 96 percent of a suitable hydrocarbon oil, preferable white oil. A preferred polymer is disclosed as a triblock polymer of the "Kraton® G type" particularly "Kraton® G 1650". Morrison et al. '329 also discloses as preferable to hold the candles in conventional jars, clear, colored, sculpted, cut glass jars, and preferably, clear glass jars are used for a jar candle.

U.S. Pat. No. 6,096,102 to Matthäi et al. disclose in particular, a candle built of a base material including between 93 and 98 weight percent of hydrocarbon oil "white oil" and between 7 and 10 weight percent of a copolymer selected from the group of tri-block, radial block and multi-block copolymers and between 0 and 10 weight percent of a di-block copolymer. Matthäi et al. '102 combines a first component, which is formed by an oil, a copolymer and synthetic paraffin, with a second component including conventional paraffin, where the first component and the second component are arranged, alternately, in layers. In addition, Matthäi et al. '102 disclose that a transparent glass body is provided which surrounds a region of a candle base material and gives the candle structure.

U.S. Pat. No. 5,578,089 to Elsamaloty discloses a clear candle made with a gel including a mineral oil combined with diblock and triblock copolymers based on synthetic thermal plastic rubbers. The clear candle is disclosed as stable, does not separate and does not flash when burned. The candle, it is disclosed, although free standing at room temperature, will preferably be supplied in a container, and it may be colored and/or scented. However, Elsamaloty '089 discloses that the container for a candle can include any of a variety of devices which can contain the gel, do not burn and do not melt, and, preferably, a faceted glass container can be used for aesthetic purposes. While Elsamaloty '089 discloses a clear candle could be provided without a container, due to the gel-like nature of the candle itself, and its potential flowability when heated, Elsamaloty '089 discloses-that it is preferred that such candles include an appropriate container.

Further, U.S. Pat. No. 6,111,055 to Berger et al. disclose the use of between 70 and 98 weight percent of hydrocarbon oil with between 2 and 30 weight percent of a copolymer selected from a group of triblock, radial block and multiblock copolymers, and from 0 to 10 weight percent of a diblock copolymer. Berger et al. '055 also discloses the combination of a candle with the use of a solid coating placed around the candle to enhance mechanical stability of the gelled body.

SUMMARY OF THE INVENTION

It is an object, among other objects, of the present invention, to provide a transparent, elastic and free standing composition for the manufacture of free standing candles, formed with a mixture of a hydrocarbon oil in a relation of about 75 to about 88 in weight percent, typically 73 to 88 weight percent and desirably 83.8 weight percent, and at least one copolymer selected from the group of triblock polymers and diblock polymers in a proportion from about 12 to about 25 in weight percent, typically 12 to 27 weight percent and desirably 16.2 weight percent where the hydrocarbon oil has a viscosity of at least 180 SUS at 37° C. (100° F.) and, when the viscosity is in cSt, the viscosity of the hydrocarbon oil being greater than 32 cSt at 40° C. (104° F.), and the hydrocarbon oil having flash point greater than 220° C. (425° F.).

In a preferred embodiment of the composition of the present invention, the hydrocarbon oil has a viscosity of 340 SUS at 37° C. (100° F.) and when the viscosity is in cSt, the hydrocarbon oil has a viscosity greater than or equal to 67.8 cSt at 40° C. (104° F.), the hydrocarbon oil has a flash point at 240° C. (464° F.), and the selected copolymers are three-block polymers "Kraton® G 1652".

Likewise, it is also the object, among other objects, of the present invention, to provide a free standing candle, manufactured with the mixture of: a hydrocarbon oil in a relation of about 75 to about 88 in weight percent, typically 73 to 88 weight percent and desirably 83.8 weight percent, and at least one copolymer selected from the group of triblock and diblock polymers in a proportion of about 12 to about 25 in weight percent, typically 12 to 27 weight percent and desirably 16.2 weight percent; where the hydrocarbon oil has a viscosity of at least 180 SUS at 37° C. (100° F.) and when the viscosity is in cSt, the viscosity of the hydrocarbon oil is greater than 32 at 40° C. (104° F.), and the flash point of the hydrocarbon oil being greater than 220° C. (425° F.), the candle maintaining a free standing condition when is lit by means of a flame produced as consequence of the combustion of a wick, the wick crossing the body of the candle and projecting toward outside one of its ends. Preferably, the candlewick is a cotton string, imbibed in an alcoholic solution of vegetal resin, such as pine resin. In the present invention due to the elasticity of the candle's composition, the candlewick is firmly retained in a passing hole produced when the composition of the present invention is cold, the candlewick crossing the body of the candle in longitudinal correspondence to an axis of symmetry extending from an inferior or lower base of the candle.

Due to the above described special characteristics of the composition of the present invention, a free standing candle can be built by the union of a plurality of different format minor portions, wherein the minor portions are and individually made with a mixture of a hydrocarbon oil in a relation of about 75 to about 88 in weight percent, typically 73 to 88 weight percent desirably 83.8 weight percent, and at least one copolymer selected from the group of triblock polymers and diblock polymers in a proportion from about 12 to about 25 in weight percent, typically 12 to 27 weight percent and desirably 16. 2 weight percent, where the hydrocarbon oil has a viscosity of at least 180 SUS at 37° C. (100° F.) and, when viscosity is in cSt, the viscosity of the hydrocarbon being greater than 32 cSt at 40° C. (104° F.), and the flash point of the hydrocarbon oil being greater than 22° C. (425° F.).

Also, the above-described mixture or composition of the present invention can include dye essences, which can be combined with aromatic fragrances, as well as air bubbles distributed in the part or all of the thickness of the candle and the air bubbles can be of different sizes. Likewise, the candle body of the present invention can include decorative elements arranged in the inner part of the thickness of the candle, which, due to the particular transparency of the composition of the present invention, the decorative elements can be visible from outside of the candle, which decorative elements are located in the portion of the composition forming the candle not adjacent to the candlewick.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE INVENTION

Figure 1:
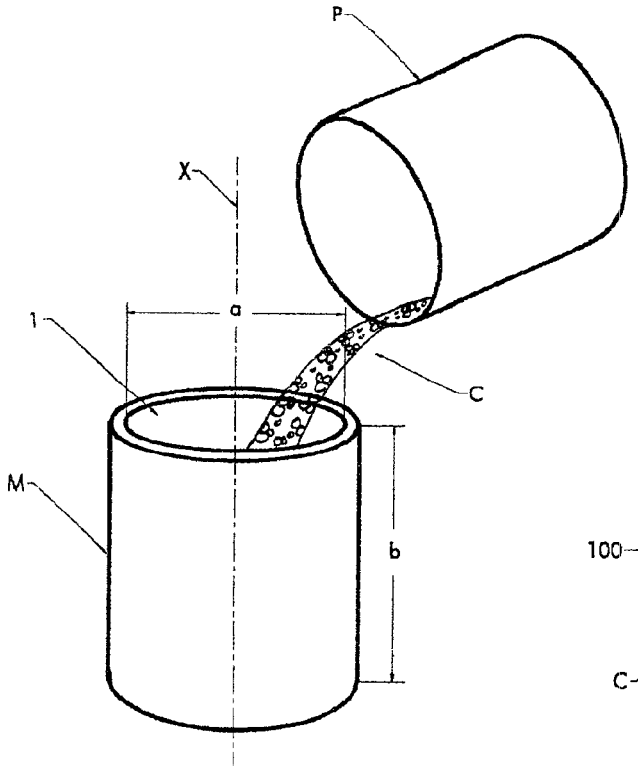
FIG. 1 is a perspective view illustrating an embodiment of a mold to conform a free standing candle made with the composition of the present invention.

More specifically, the present invention relates to a composition obtained from the mixture of hydrocarbon oil, specially white oils, and block copolymers. The present invention relates to a composition, such as for use in a candle, that has a consistency to be free-standing, and maintaining elasticity features, while the composition maintains transparency, as well as the composition enabling the configuring of bodies of various shapes and designs. The composition of the present invention, has the special particularity of allowing the incorporation of at least one candlewick in to the candle, similar to those used by candles in general, to provide a combustion of a candle made with the composition of the present invention that generates a stable and lasting flame without giving off unpleasant odors.

The composition of the invention has been particularly created for the manufacture of transparent candles which, at the same time are free-standing, that is to say, which do not need a container that supports a candle made from the composition of the present invention. Candles made from the composition of the present invention also are elastic and unbreakable when they fall or receive sudden knocks, and such candles made from the composition of the present invention desirably can be mixed with dyes and aromatic fragrances, as well as can include decorative elements within the candle that are noticeable from outside, or that provide other or inner functional resources related to the art of lighting and decorating different environments.

The above described composition of the present invention, in summary, advantageously has special qualities: it is transparent, free standing and elastic, with enough consistency to form a candle with a stable flame, that does not deform upon application of pressure and that does not get fluid during its use, such as when the candlewick is burning.

Using the composition of the present invention, it is possible to manufacture candles to have the following desirable features:

a) elasticity, so as to present a consistency solid enough to be self-supporting, without requiring a container for supporting the candle for its normal functioning;

b) resistance or resiliency to mechanical knocking or jarring without generating undesirable breaks, splits or contusions in the candle, as can happen with paraffin candles;

c) transparency, so that light can pass through the body of the candle;

d) the ability to be mixed with fragrances, so that the consumption of the candle during the flame action of burning of the candlewick or wicks also produces the release of pleasant odors;

e) the ability to be mixed with dyes, which is desirable from an aesthetic or ornamental point of view f) during manufacturing, generating the presence of air bubbles of various sizes such that distribution of air bubbles in the body of the candle can be achieved, which is useful as decorative resources;

g) mixing the composition of the present invention with other decorative elements such as various types and sizes of granule particles so as to be distributed in the thickness of the candle body, so as to be visible from outside of the candle, and decorative elements can be even more enhanced when the candle is lit, such as granule products that reflect light in various colors, such as those commonly called "purpurin" and/or "brilliantine";

h) supporting within the body of the candle of an appropriate thickness, other products or decorative bodies such as letters, numbers, little animals or other objects; and i) the composition of the present invention being a reversible or recyclable composition, since upon heating, melting, and then cooling the composition to room temperature, the candle formed of the composition of the present invention keeps the same constituent features.

Likewise, it is highlighted that all of the above described features and conditions in relation to the composition of the present invention can be maintained without affecting each other.

The reasons for the composition of the present invention providing superior and unexpected type results, are related to the chemical characteristics of the hydrocarbon oil, such as a white oil. When the values for the hydrocarbon oil and copolymer specified for the composition of the composition of the present invention are maintained, a very special relation between the viscosity and the flash point is achieved. In this regard, when the values of the hydrocarbon oil and copolymer are below the specified values for the composition of the present invention, the composition could be free standing at room temperature but the heat of the wick's combustion can melt the composition to a liquid point. On the other hand, when more polymer than what is specified in the present invention is used to harden the composition or composition, the composition or composition can inflame with the combustion produced by the candle's wick.

The above-described composition of the present invention is prepared mixing the hydrocarbon oil with a triblock copolymer, heating this mixture and stirring it regularly until it reaches 150–160° C., which is equivalent to 302–320° F. Stirring the mixture, mechanically or manually, is convenient to achieve the desirable dissolution of the polymer in the hydrocarbon oil. The hydrocarbon oil used for the composition of the present invention is desirably white oil ("Vaseline") having the following characteristics as set forth in <TABLE 1>.

TABLE 1

| Specification | Value | Method |
|---|---|---|
| VISCOSITY SUS @ 37.8° C. (100° F.) | 345 | ASTM D 88 |
| VISCOSITY cSt @ 40° C. (104° F.) | 32 (67.8) | ASTM D 445 |
| DENSITY @ 20° C. (68° F.) | 0.88 | ASTM D 1298 |
| FLASH POINT | 240° C. (464° F.) | ASTM D 97 |
| TURBIDITY POINT | −5° C. (23° F.) | ASTM D 2500 |
| COLOR AL PT-CO (EX ALPHA) | 10 | ASTM D 1209 |

ASTM = American Society for Testing and Material (site: www.astm.org)
METHOD = Method of analysis
SUS and cSt (centistokes) are measure units of each essay Two of these values for the hydrocarbon oil of TABLE 1 are very important when choosing the hydrocarbon oil, such as the white oil ("Vaseline"), which are: the flash point desirably should not be inferior to or less than 200° C. (392°

F.) and the viscosity desirably should not be inferior to or less than 32 cSt, desirably at least 67.8 cSt.

The other values for the hydrocarbon oil in TABLE 1 can change, dependent upon the specifications of the product, without altering the preparation of the composition of the present invention.

In relation to the triblock copolymer used in the above-described composition or composition of the present invention, the most desirable is a triblock copolymer with polystyrene end blocks and a rubbery poly (ethylene butylene) mid block. The polymer used in the preparation of composition of the present invention desirably should have the following preferred characteristics as set forth in <TABLE 2>.

TABLE 2

| | |
|---|---|
| Tensile strength, psi | 4,500 |
| Elongation at break, % | 500 |
| Modulus at 300% extension, psi | 700 |
| Film appearance | Clear, water white |
| Solution viscosity *25% w in toluene, cps | 1800 |
| Melt viscosity, melt index, condition G, Gms-10 min | 1 |
| Styrene-rubber ratio | 30–70 |

*Brookfield viscosity meter Model RTV to 25° C. (77° F.)

Polymers that better suit the above-described characteristics set forth in <TABLE 2> are Kraton® G 1652 of Shell Chemicals, for example.

To prepare the above-described composition of the present invention, hydrocarbon oils are used that have the feature of remaining liquid within a temperature range between 0° C. (32° F.) and 200° C. (392° F.), as well as the condition of being transparent and of high density. One of the hydrocarbon oils that best adapts to these conditions is a 180 density white oil ("Vaseline"). Likewise, for the composition of the composition of the present invention the above-described polymers are used.

The first step in preparing the composition or mixture of the present invention is to mix two-block or three-block polymers, especially an S-EB-S chain, which are capable of retaining more than twenty times its weight in hydrocarbon oil. Among known polymers suitable for use in the present invention, there are different kinds of polymers, but those of "Kraton® Series G" are the best or preferred for use in the composition or mixture of the present invention. These "Kraton® G" series polymers correspond to a type of three-block polymer, such as "S-EB-S" type. It is also possible to use "Kraton® Series D" type, but they typically do not achieve as good a result as in the previous case. The quantity of polymer to be used in the composition or mixture of the present invention relates to the level of hardness intended for the mixture.

Starting from the previously mentioned elements of the hydrocarbon oil and copolymer, the process then proceeds to mix the mixture of the hydrocarbon oil and copolymer through normal stirring, at a temperature ranging from 80° C. (176° F.) to 160° C. (320° F.), up to the solubilization of the mixture and that leaves the solution transparent.

Referring to FIG. 1, for the pouring in molds, materials of container P and mold M of delicate finish and that resist temperatures up to 160° C. may be used. Varying the temperature and speed of pouring of the mixture or composition C of the present invention these can be obtained variations in relation to the final finish of the composition C of the present invention, which can include air bubbles of different sizes or can be without air bubbles. In FIG. 1 a mold M for the function of forming a candle of the present invention is illustrated, the mold M having a completely open superior or upper base, and the mold M having an internal diameter a and a height b, as illustrated in FIG. 1. For the pouring of the composition C from the container P to inside the mold M, the mold M must be able to resist without deforming temperatures of up to 160° C. (320° F.), and in this regard, stainless steel, brass, aluminum, copper, bronze, silicon rubber etc. are the most convenient and desirable materials used for the mold M. In relation to the interior surface 1 of the mold M, it is very important that the interior surface 1 be brilliant, neat and polished, so that the composition C when formed into a candle of the present invention will have the same neatness and brightness. By changing the temperature and the speed of the pouring of the composition C from the container P to inside the mold M, various different finishes can be obtained for the candle of the present invention.

Once the composition C cools in the mold M to room temperature, a completely clear, transparent composition without air bubbles is obtained when pouring the composition C in the mold M at a temperature between 150° C. (302° F.) and 160° C. (320° F.) to provide a clear, transparent candle as candles 100, 100A, 100B and 100C of FIGS. 2 through 5.

Figure 7:
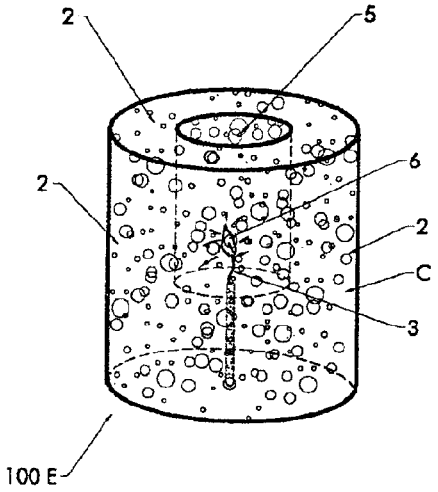
FIG. 7 is a schematic perspective view illustrating an embodiment of a free standing candle of the present invention formed with the composition of the invention, which includes air bubbles.

When the temperature of the composition C is between 100° C. (212° F.) and 120° C. (248° F.) when pouring the composition C into the mold M, the composition C will have air bubbles 2 when it cools to room temperature to provide a clear, transparent candle having air bubbles 2, such as candle 100E of FIG. 7. Air bubbles 2 can also appear in the composition C when the speed and the height of the pouring are changed, since that allows the entrance of more air or less air into the composition C.

Figure 2:
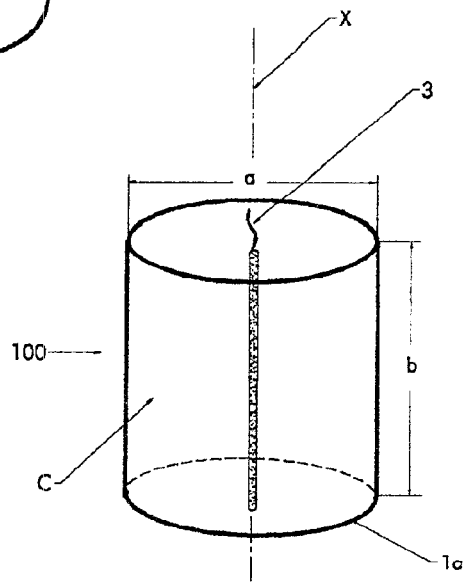
FIG. 2 is a perspective view illustrating a free standing candle of the present invention molded in the mold for FIG. 1.

FIG. 2 represents a free standing candle 100 already formed according to the format and dimensions of the mold M of FIG. 1. For the shaping of a candle of the present invention, the composition C is capable of keeping the candlewick 3 in a similar way as it is disposed in conventional candles. Conventional paraffin candlewick, as well as candlewicks for gel or especially prepared for these types of candles, such as a cotton string imbibed in a solution of vegetal resin, such as pine resin, can be used for candlewick 3. The candlewick 3 can be placed during the manufacture of the candle, such as candle 100, in the traditional way, that is to say, arranging same in correspondence with the longitudinal axis X of the mold M and the candle extending from a lower base 1*a* of the candle (FIGS. 1 and 2) and fixing the candlewick 3 so as to be stretched or erected so as not to move while the mixture or composition C is poured into the mold M.

It is also possible to place candlewick 3 in the candle by taking advantage of the feature of elasticity of the composition C of the present invention. Therefore, once the candle has been shaped in the mold M, these is made an aperture or a passing hole 4 in the candle, such as candles 100B and 100D of FIGS. 4 and 6 through which the entire candlewick 3 moves forward till the candlewick 3 is arranged in a condition of usage in the candle. The passing hole 4 is produced when the candle desirably is at room temperature, the passing hole 4 extending through the candle in longitudinal correspondence to an axis of symmetry L extending from a lower base B of the candle, such as in candles 100B and 100D of FIGS. 4 and 6. The candlewick 3 is kept stable in the candle, such as in candles 100B and 100D, without relative displacement due to the mentioned elasticity of the material or composition C of the present invention.

Considering the foregoing, it is possible to shape candles, such as candles 100 through 100F of FIGS. 2 through 8, of different sizes and dimensions, which will have a minimum size that depends on the candlewick 3 size used, since the combustion temperature generated and the quantity of adjacent material melted of the candle depends on the type and proportions of the candlewick 3 used in the candle. It is possible to manufacture candles of different forms and sizes taking into account the candlewick 3's thickness and the melting diameter of the candle in relation to candle's minimum diameter.

In the candles of the present invention, such as candles 100 through 100F, providing a candle diameter larger than the melting diameter of the candle, a decorative effect can be achieved that is highly pleasant, since the portion of the material or composition C in the candle that is not melted keeps its original structure. For example, a candle of a diameter which is twice the melting diameter of the candle produced during the combustion of a candlewick 3, 3*a*, 3*b*, 3*c*, produces a tunneling 5, 5*a*, 5*b*, 5*c* since the candlewick's flame 6, 6*a*, 6*b*, 6*c* will melt a certain diameter of the composition C around the candlewick 3, 3*a*, 3*b*, 3*c* but the rest of the candle will remain unchaged. The flame 6, 6*a*, 6*b*, 6*c* consumes the candlewick 3, 3*a*, 3*b*, 3*c* during the combustion and, as consequence, the candlewick 3, 3*a*, 3*b*, 3*c*—is shortened by such combustion, and the light produced by the flame 6, 6*a*, 6*b*, 6*c* inside the candle, such as candles 100B through 100F of FIGS. 4 through 18, for example, will go through the transparent body of the candle achieving a very special, beautiful and unique effect.

Figure 3:
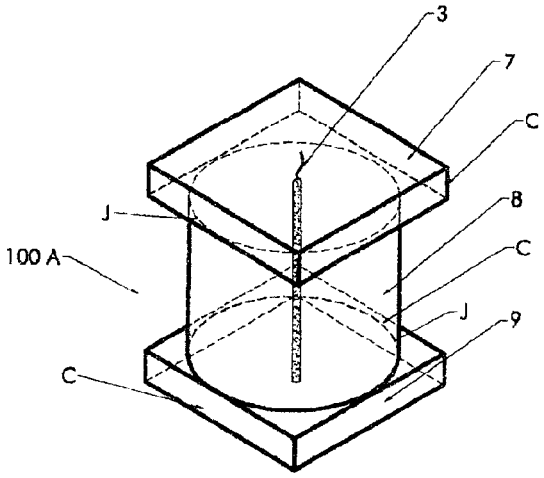
FIG. 3 is a perspective view illustrating an embodiment of a free standing candle of the present invention formed by a plurality of minor portions made with the composition of the present invention and united one with each other to form a unitary candle body.
Figure 4:
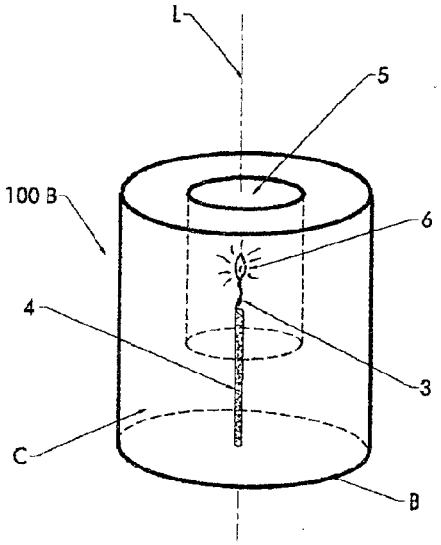
FIG. 4 is a schematic perspective view illustrating a free standing inflamed candle of the present invention with the candlewick of the candle consumed to approximately half its height.

FIG. 3 illustrates a free standing candle 100A of the present invention built with a plurality of minor portions 7, 8 and 9 of the composition C, the minor portions being of different sizes and forms. The minor portions 7, 8 and 9 forming the candle 100A can be formed by different methods, such as molding, lamination, extrusion, etc. When the minor portions 7, 8 and 9 are united one with the other to form a unitary structure, a free standing candle 100A as illustrated in FIG. 3, having properties of candles of the present invention, as previously mentioned is provided.

The composition C's shapes and formats obtained for the above-mentioned minor portions, such as minor portions 7, 8 and 9, can be laminar, cylindrical, rectangular, and any other suitable design. By using heat to melt the composition C of the present invention in the desired joint point J of two of the minor portions obtained, the melted composition of both minor portions will mix and, once cooled, the minor two portions are united forming one single piece of a unitary structure. This allows an artist, for example, to design and manufacture candles of varying shapes and designs by making and joining minor portions formed of the composition C of the present invention having different colors, finishes and shapes.

Figure 5:
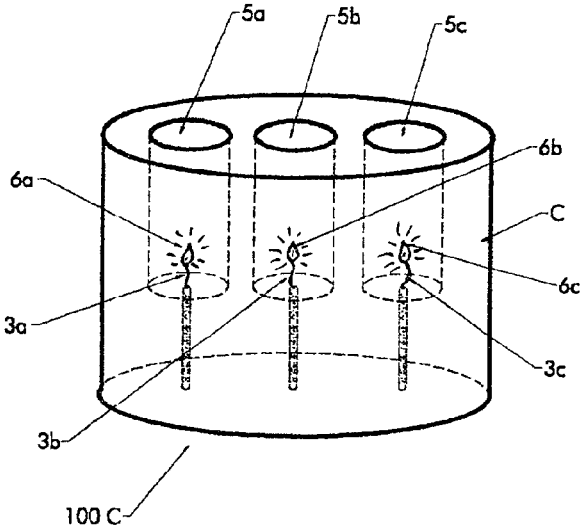
FIG. 5 is a schematic perspective view illustrating an embodiment of a free standing inflamed candle of the present invention formed with the composition of the present invention, which includes a plurality of lit candlewicks.

Referring to FIG. 5, an embodiment of a candle 100C of the present invention is illustrated formed of the composition C of the present invention that allows the formation of free standing candles of a relatively large diameter so as to allow the placing of more than one candlewick 3 in the candle. In the candle 100C of FIG. 5, a plurality of candlewicks 3*a*, 3*b*, 3*c* are illustrated which are reduced by their combustion generating tunnelings 5*a*, 5*b*, 5*c* lightened with flames 6*a*, 6*b*, 6*c*.

Further, the composition C of the present invention also allows the possibility of composition C of candles 100 through 100F of FIGS. 2 through 8 being mixed with colorants by adding dyes to color the composition C and, also, the composition C of candles 100 through 100F of FIGS. 2 through 8 can be mixed with aromatic fragrances to perfume the ambient air during the combustion of the candlewicks 3*a*, 3*b*, 3*c*.

Figure 6:
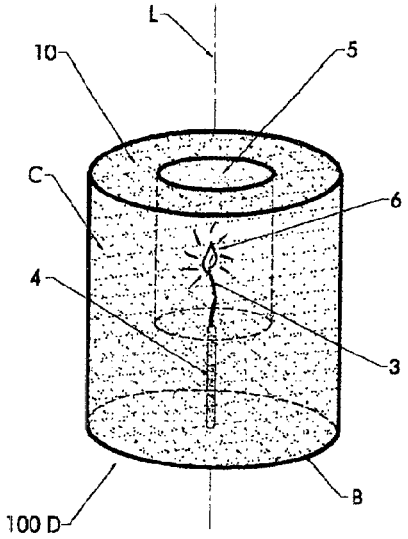
FIG. 6 is a schematic perspective view illustrating an embodiment of a free standing candle of the present invention formed with the composition of the invention, which includes granule particles, such as "purpurin" as a decorative element.

Additionally, FIG. 6 illustrates a candle 100D of the present invention where the composition C of the present invention has been mixed with a granular material 10, such as "purpurin", for example.

Figure 8:
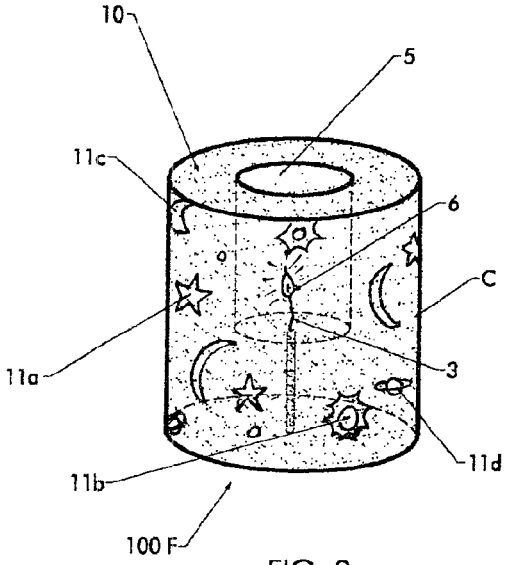
FIG. 8 is a schematic perspective view illustrating an embodiment of a free standing candle of the present invention formed with the composition of the invention, which includes decorative elements.

Also, FIG. 8 illustrates a candle 100F of the present invention where the body of the candle 100F has a plurality of different decorative elements 11*a* through 11*d*, for example, distributed in the interior of the candle 100F. The placing of the decorative elements 11*a* through 11*d*, for example, in the body of the candle 100F can be allowed by placing the decorative elements 11*a* through 11*d*, for example, in the composition C of the present invention once is poured from container P into the mold M (FIG. 1) and before the composition cools to room or ambient temperature. Such decorative elements can also include a logo, a name, a picture, an object, etc., for example, set in the composition C of the candle before cooling of the composition to room or ambient temperature. The composition C of the present invention will hold the decorative elements 11*a* through 11*d*, for example, and, due to the composition C's transparency, the decorative elements 11*a* through 11*d*, for example, will be visible from outside of the candle, such as illustrated in candle 100F of FIG. 8.

The following Examples 1 and 2 are now described to illustrate exemplary embodiments of the composition or mixtures and candles of the present invention.

EXAMPLE 1

A mixture of the present invention containing white oil in a relation of 75 to 88 weight percent and a three-block polymer of "Kraton® G series" type in a relation of 25 to 12 weight percent was prepared. This composition was obtained heating the mixture at a temperature ranging between 100. C (212° F.) and 160° C. (320° F.), desirably 150° C. (302° F.) to 160° C. (320° F.), stirring till the mixture becomes clear and transparent. In this case, a dye and an aromatic fragrance were added and the obtained mixture was poured in a cylindrical mold of 7 cm diameter and 7 cm of height proceeding to its cooling and hardening.

Once the mixture of composition is cooled, at room temperature, the demolding was accomplished and the placement of the candlewick or wick was performed. In this case the candlewick was formed by a cotton string imbibed in an alcoholic solution of pine resin. A passing aperture or passing hole in correspondence to the axis of symmetry of the cylindrical body of the candle was formed, in which the candlewick was introduced. From the above-described process, a free standing, transparent and color candle was obtained. The candle thus formed kept a flame, as a product of the combustion generated from the candlewick, which flame maintained constant during 40 continuous hours of burning.

EXAMPLE 2

A mixture of the present invention of hydrocarbon oil and copolymer similar to that of Example 1 was prepared, and, previous to the stage of cooling, the mixture or composition thus prepared was poured in a plurality of different molds to provide a plurality of minor portions. These minor portions poured into the plurality of different molds were mixed with different coloring essences and then exposed to cooling individually, as explained previously. In this regard, different forms and shapes of compositions were obtained, such as sheets of different sizes, strings of different thickness, as well as portions without defined format, all of them in varying colors, as explained previously.

Using the above-mentioned minor portions in a solid state, a handmade design of different structures were performed assigned to shape candles; and the plurality of different minor portions were joined together, applying heat, thus obtaining candle bodies of different shapes and sizes, as explained previously, having a unitary structure for the candle body formed from the different minor portions. A corresponding candlewick was introduced in the body of the thus formed candle, following the same method explained in the previous Example 1.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A transparent, elastic and free standing composition for the manufacture of candles, comprising:

a hydrocarbon oil in a proportion of from about 75 to about 88 in weight percent; and at least one copolymer selected from the group consisting of triblock polymers and diblock polymers in a proportion of from about 12 to about 25 in weight percent, the weight percent of the hydrocarbon oil and the weight percent of the at least one copolymer being in relation to a mixture of the hydrocarbon oil and the at least one copolymer, a viscosity of the hydrocarbon oil being 67.8 cSt at 40° C., and the flash point of the hydrocarbon oil being greater than 220° C.

2. A transparent, elastic and free standing composition for the manufacture of candles, comprising:

a hydrocarbon oil in a proportion of from 73 to 88 in weight percent; and at least one copolymer selected from the group consisting of triblock polymers and diblock polymers in a proportion of from 12 to 27 in weight percent, the weight percent of the hydrocarbon oil and the weight percent of the at least one copolymer being in relation to a mixture of the hydrocarbon oil and the at least one copolymer, a viscosity of the hydrocarbon oil being 67.8 cSt at 40° C., and the flash point of the hydrocarbon oil being greater than 220° C.

3. A candle, comprising:

a hydrocarbon oil in a proportion from about 83.8 weight percent and said hydrocarbon having a viscosity of 67.8 cSt at 40° C. and a flash point of 240° C., said hydrocarbon oil having a feature of remaining liquid within a temperature range between 0° C. and 200° C., said hydrocarbon being transparent; and at least one copolymer selected from the group consisting of triblock copolymer and diblock copolymer, said copolymer being in a proportion from about 16.2 weight percent, said candle being elastic and transparent, said candle maintaining a free standing condition even when the candle is lit.

* * * * *